United States Patent [19]

Duimstra

[11] Patent Number: 4,998,082

[45] Date of Patent: Mar. 5, 1991

[54] LATCHING RELAY SWITCH ASSEMBLY

[75] Inventor: Frederick A. Duimstra, Anaheim Hills, Calif.

[73] Assignee: Babcock, Inc., Orange, Calif.

[21] Appl. No.: 399,076

[22] Filed: Aug. 28, 1989

[51] Int. Cl.[5] ..... H01H 1/66; H01H 51/00; H01H 9/04; H01H 13/04

[52] U.S. Cl. ..... 335/154; 335/79; 335/151; 335/179; 335/181; 335/202; 200/302.1

[58] Field of Search ..... 335/78, 79, 81, 84, 335/85, 154, 177, 179, 180, 181, 182, 183, 202, 151; 200/302.1

[56] References Cited

U.S. PATENT DOCUMENTS

| | | | |
|---|---|---|---|
| 3,534,192 | 10/1970 | Miles | 335/151 |
| 3,813,620 | 5/1974 | Adkins | 335/179 |
| 4,105,982 | 8/1978 | Oeschger | 335/154 |
| 4,638,275 | 1/1987 | Belbel et al. | 335/151 |

*Primary Examiner*—Steven L. Stephan
*Assistant Examiner*—Nilay H. Vyas
*Attorney, Agent, or Firm*—G. Donald Weber, Jr.

[57] ABSTRACT

A latching relay switch assembly which includes a coil section and a switch or contact section. The coil section includes at least one permanent magnet and at least one electromagnet. The respective sections are, generally, arranged in separate locations or cavities in the assembly. The switch is latched by a permanent magnet assembly and selectively switched by an overriding electromagnetic assembly.

42 Claims, 6 Drawing Sheets

LATCHING RELAY SWITCH ASSEMBLY

GOVERNMENT RIGHTS

This invention was made under the auspices of the U.S. Department of Energy wherein the U.S. Government obtains a non-exclusive, royalty free, irrevocable license to practice or have practiced the invention.

BACKGROUND

1. Field of the Invention

This invention is directed to a latching relay switch assembly, in general, and to such a latching switch assembly in which the coil section is hermetically separated from the switch section, in particular.

2. Prior Art

There are many types of switches and relays which are known in the art. These switches and relays are often arranged together to form a solenoid or the like. The electrical relay is, generally, a device which utilizes the variation of current in one electric circuit as a controlling factor in another. For example, a change in current in one circuit may cause or permit a current in another circuit, in response to the operation of an intermediate relay. The relays, switches and/or solenoids which are known in the art are almost too numerous to enumerate herein. These relays have been widely used, particularly in automatic or semi-automatic devices, for the protection or operation of electric power equipment, or for communication systems. Suitable relays may detect over-current, under-current, over-voltage, under-voltage, overload, reverse current, reverse power, abnormal frequency, high temperature, short circuits, phase unbalance, or the like. Relays may be highly specialized protective relays which will detect an abnormality and, for example, open (or close) a circuit associated with the abnormality. Commonly, relays are used as a means to direct current from an electrical supply to a load circuit.

However, the known and existing relay switches have certain shortcomings when constructed as a single chambered, unitary device. In many applications, this is a problem because of the potential for interaction between the control circuits (i.e. coils) and the switching circuits and armature. Also, it is possible that the switching portion of the device can be contaminated by the components and materials which are utilized in the coil section. Thus, even in hermetically sealed devices, failures due to corrosion or the like can occur. The outgas or vapor products associated with the commonly used organic materials required for coil construction have historically caused organic films to occur on the contact surfaces of the switches which cause high contact resistance and in some cases, even cause open circuits. Likewise, particulate shedding from the coil assembly can also be a problem. Also the known and existing relays of subminiature configuration commonly stick in a null position because of friction in the armature suspension system.

PRIOR ART SUMMARY

A preliminary search of the prior art was not conducted with regard to this invention.

CO-PENDING APPLICATION

Reference is made to the co-pending application entitled NON-LATCHING RELAY SWITCH ASSEMBLY by F. A. Dumistra, bearing Ser. No. 07/399,013 and filed on Aug. 28, 1989.

SUMMARY OF THE INSTANT INVENTION

This invention is directed to a latching relay switch wherein the magnetic portion of the assembly (including magnets, cores and coils) is separated from the switch portion of the assembly (including armature and contacts). This arrangement permits those components, e.g. coils, insulated wires, and the like, which include organic compounds to be isolated from the contacts.

By selectively arranging the cores, coils and magnets, a latching relay operation is provided. In addition, the armature in the switch portion of the device can be suspended on a taut band or it can be pivoted on pin mountings in order to avoid a neutral or null position of the armature.

In the preferred embodiment, the entire relay switch is mounted within a single, hermetically sealed, housing but separated by an impervious interface membrane between the coil section and the switch section.

In a preferred embodiment, a pair of electromagents are mounted in the magnet portion of the switch in a side-by-side arrangement. The cores of these electromagnets are disposed colinearly. A pair of permanent magnets are mounted adjacent to the electromagents. The permanent magnets are disposed colinearly but in quadrature relation to the electromagnets. A common flux bridge is connected to the top ends of the permanent magnets as well as the cores of the electromagnets. The lower ends of the permanent magnets are connected to the opposite ends of a lower flux bridge while the lower ends of the electromagnet cores are disposed adjacent opposite ends of the movable armature in the switch portion of the assembly.

DESCRIPTION OF THE PREFERRED EMBODIMENT

Figure 1:
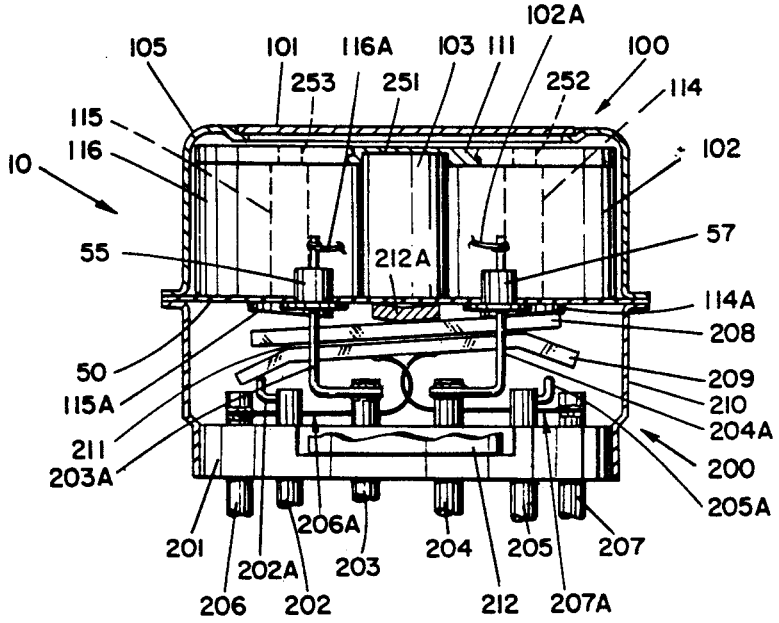
FIG. 1 is a schematic, cross-sectional view of the latching relay switch of the instant invention.

Referring now to FIG. 1, there is shown a simplified schematic, but representative, cross-sectional view of the relay switch 10 of the instant invention.

In this embodiment, it is clear that the relay switch apparatus 10 is comprised of two separate and distinct sections or components. One section is the coil assembly 100 and the other section is the switch assembly 200. These two sections are completely separate and sealed off from each other by means of membrane 50. Typically, membrane 50 is fabricated of 304L Stainless Steel (the same non-magnetic material as the housing components 105 and 220, the lid 101 and the header 201). The membrane 50 is impervious to all gases, including helium which is used as a leak detection gas. Inasmuch as the coil assembly 100 is constructed, sealed and leak tested separately, any of the organic elements and associated gaseous products which may be generated by such organic elements, are sealed within. This construction ensures that any organic materials which may be used in the fabrication of the coil assembly 100 cannot contaminate the contact surfaces of the switch assembly 200.

In this embodiment, the base of the relay assembly is fabricated of a header 201 which is, typically, formed of 304L stainless steel. A plurality of pins 202 through 207 extend through the header 201. The pins are fabricated of Alloy 52 with a copper core. A glass-to-metal seal (not shown) is used to mount the pins in the header 201. In this view, only six pins are shown. However, as shown in other views, ten (10) pins are used. It is to be understood, of course, that any number of pins (within volume restrictions) can be utilized. Typically, these pins provide six connections for the two switched contact pairs and four connections for the coil drive (as described hereinafter). For example, in the application shown in FIG. 1, pin 202 represents the normally closed contact and pin 205 represents the normally open contact. Similarly, pins 203 and 204 represent two of the four connections made to the coils 116 and 102, respectively. Pins 206 and 207 represent the common connections to the movable contacts 209A and 209B (See FIG. 4).

The connections to the switch mechanism are made directly via the header pins. The connections to the coils 102 and 116 are carried from the header pins, through the switch assembly cavity 200, to glass-metal feedthroughs 55 and 57 which pass through the interface membrane 50. The connections to the coils 102 and 116 are made on the coil assembly side of the feedthrough 57 and 55, respectively.

More particularly, a coil assembly 100 is fabricated by assembling a coil 102 on a magnetic core 114 and a coil 116 on a magnetic core 115. The coil assemblies are mounted on the interface membrane 50. The coils 102 and 116 are made of magnet wire, for example, of the 220 class, type M, while the cores 114 and 115 are made of low carbon iron Carpenter Consumet, vacumet, electrical iron, or Hyperco 50 Alloy, for example. The cores 114 and 115 are aligned with each other along a diameter axis of the assembly. The lower ends 114A and 115A of cores 114 and 115, respectively, extend through the membrane 50. The lower ends 114A and 115A of the cores 114 and 115 may be slightly beveled to mate with the armature 208, as described hereafter. Conversely, the ends of armature 208 may be beveled to mate with the lower ends of the cores. Where the interface membrane 50 is penetrated by the ends of the cores 114 and 115, the interface membrane 50 is sealed to the cores by means of laser welding, for example.

Figure 3:
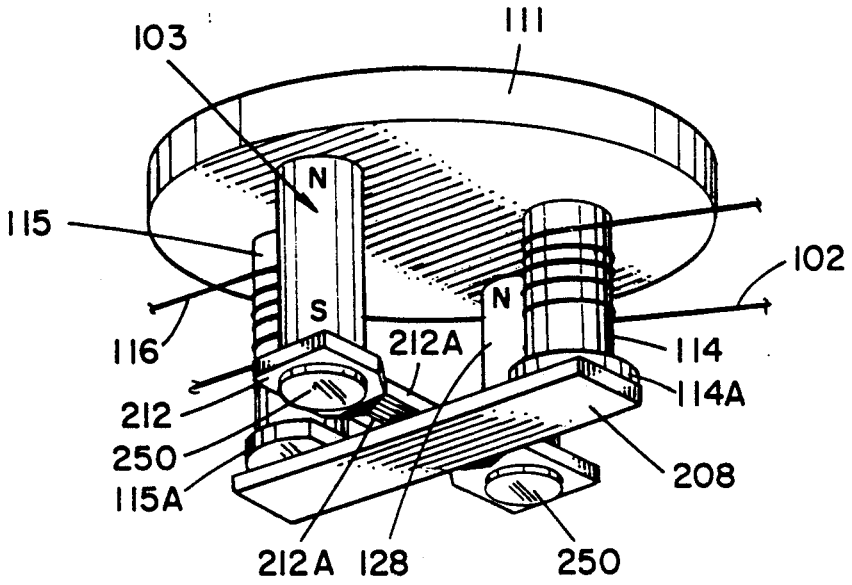
FIG. 3 is a schematic, isometric representation of the arrangement of the magnetic portion of the latching relay of the instant invention.

The coil connections, for example, connections 116A and 102A, are made via the feedthroughs 55 and 57, as noted above. These connections are produced, typically, by means of resistance welding the coil lead wires to the feed-through terminals. In addition, the coil assembly 100 includes at least one permanent magnet 103. Typically, a counterpart permanent magnet 128 is included on the opposite side of the coils 102 and 116 (see FIG. 3). In a preferred embodiment, the permanent magnets are formed of Alnico, or equivalent material. To permit maximum volume for the electromagnetic coils 102 and 116, the two permanent magnets 103 and 128 (see FIG. 3) are positioned off the center-line of the relay defined by a line drawn between the cores 114 and 115.

Figure 5:
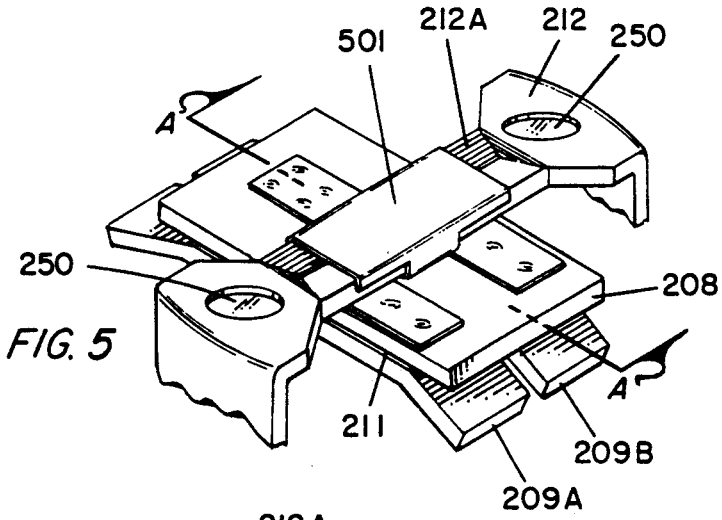
FIG. 5 is a schematic, partially broken away representation of the taut-band armature suspension system.
Figure 5A:
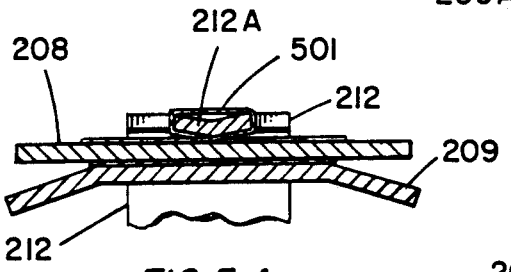
FIG. 5A is a partial cross-sectional view of the suspension system shown in FIG. 5.
Figure 6:
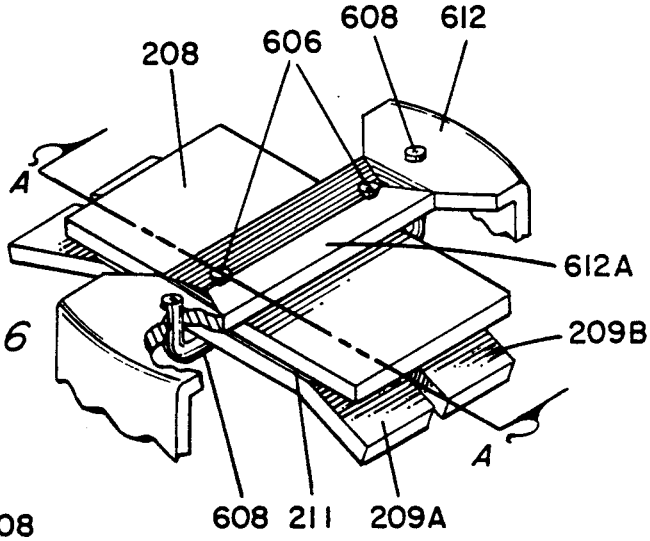
FIG. 6 is a schematic, partially broken away representation of the pivot pin armature suspension system.
Figure 6A:
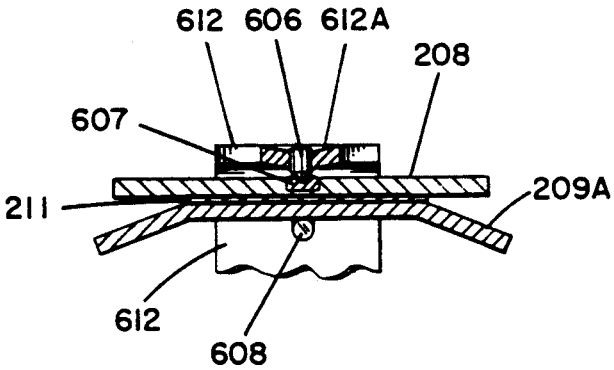
FIG. 6A is a partial cross-sectional view of the suspension system shown in FIG. 6.

The permanent magnet 103 and its counterpart (i.e. magnet 128) are mounted on opposite ends of lower bridge 212 which is fabricated of magnetic materials similar to those noted relative to cores 114 and 115. Thus, permanent magnets 103 and 128 are aligned colinearly along a diameter axis of the assembly. The centers of the permanent magnets 103 and 128 are arranged diagonally across from each other as are the cores 114 and 115. The lower bridge 212 is, generally, bow-tie shaped and includes a slightly V-shaped or grooved center portion 212A as seen in FIGS. 1, 5 and 6. The center portion 212A operates as a fulcrum as described hereafter. Relatively flat or planar ends of lower bridge 212 are arranged to support the permanent magnets 103 and 128 (see FIG. 3). Recesses 250 are provided to receive the lower ends of the permanent magnets. The lower bridge 212 also provides a flux return path for the permanent magnets.

The upper bridge 111 is essentially, disk shaped and fabricated of substantially the same material as the lower support bridge 212. The upper bridge 111 is placed on the upper ends of the magnet cores 114 and 115, as well as on the ends of the permanent magnets 103 and 128. A plurality of recesses identified by reference numerals 251, 252, and 253 are formed in the lower surface of bridge 111. These recesses are adapted to receive the upper ends of the permanent magnets and the electromagnetic cores. The flux from the upper ends of the two permanent magnets is brought to the tops of the coil cores 114 and 115 by the upper bridge 111. The flux from the lower ends of the two permanent magnets is brought to the center of the armature 208 by the lower bridge 212. The armature 208 completes the magnetic path.

Figure 4:
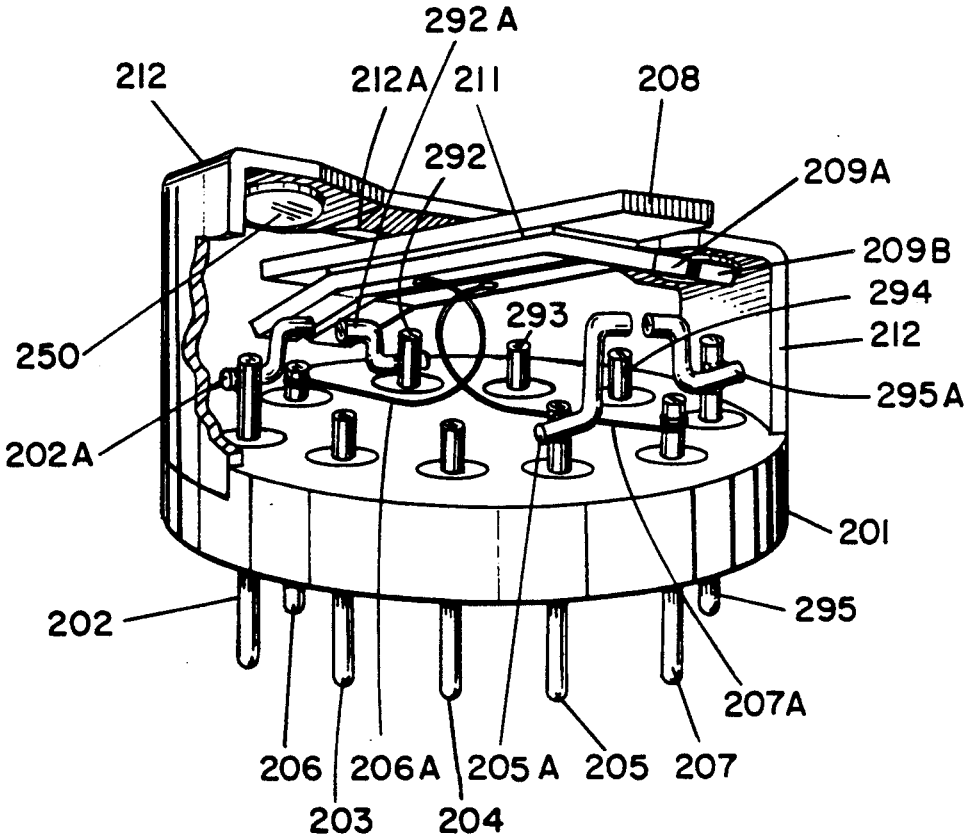
FIG. 4 is a schematic, partially broken away representation of the switch (or contact) portion of the latching relay of the instant invention.

When the coils or the cores are in place and fully checked out, the upper housing 105 is placed over the coil assembly 100 and sealed to the interface membrane 50 by means of laser welding around the perimeter of the membrane. The assembly is again checked for functional operation, wherein the coil housing 105 is filled with suitable encapsulating materials such as an Epoxy (Epon 828, with Z hardener and a Mica filler), a formulation that has proven compatible with encapsulation of coil assemblies. A disk or lid 101 is then placed at the opening of the housing 105 and is laser welded thereto. The coil assembly 100 is then checked for hermeticity by any suitable method preferably using a helium bomb-/mass spectrometer method (MIL-STD-202F, Method 5.4.3, Procedure IIIa). The moving portion of the switch mechanism, i.e. armature 208, is attached to and supports the common contacts 209A and 209B. Typically, armature 208 provides a solid but moveable support for the common contact 209 which, as will be seen in FIGS. 4, 5 and 6, may include a pair of contacts 209A and 209B. A layer of insulation 211 such as Kapton with Pyralux 222 is disposed between contacts 209A and 209B and the armature 208. The moving switch assembly (comprising the armature and contacts) is mounted at the lower support bridge 212. The lower bridge assembly is placed over the header 201 and the ends of bridge 212 (shown broken away in FIG. 1) are spot welded in place to the sides of header 201 (as shown in FIG. 4). The stationary switch contacts 202A and 205A are welded to the pins 202 and 205 which are mounted at the header 201. As seen in FIG. 4, the counterpart contacts 292A and 295A are welded to the counterpart pins 292 and 295. The coil connection pins 203 and 204 are spot welded to feedthroughs 55 and 57, respectively. As seen in FIG. 4, the counterpart pins 293 and 294 are also provided to be connected to feedthroughs related to the coils. These feedthroughs are not shown for convenience.

The ends of the contacts 209A and 209B are angled downwardly and selectively bear on the fixed contacts 202A, 292A, 205A and 295A which are welded to the pins 202, 292, 205 and 295, respectively, in the header 201. (See, typically, FIG. 4). These contacts are also gold-plated Consil 995 drawn wire or pure silver wire, which have a controlled surface finish and controlled processing to assure freedom from inclusions and fissures. The angulation of the contact ends permits a flexing brushing contact to be effected. The common connections are brought from contacts 209A and 209B on the armature, through coiled copper straps 206A and 207A, to the appropriate header pins 206 and 207. The two straps 206A and 207A are mounted and coiled in opposition, so that any resultant torques on the armature are cancelled out.

The switch assembly cover 210 is then placed over the header 201 and laser welded to the perimeter of the interface membrane 50 and the lower perimeter of the housing 105. The switch assembly cover 210 is then laser welded to the perimeter of the header 201. The placement and welding in place of the cover 210 is, typically, accomplished in a chamber containing the correct mixture of gases such as 10% helium, 5% oxygen and the remainder dry nitrogen.

Figure 2A:
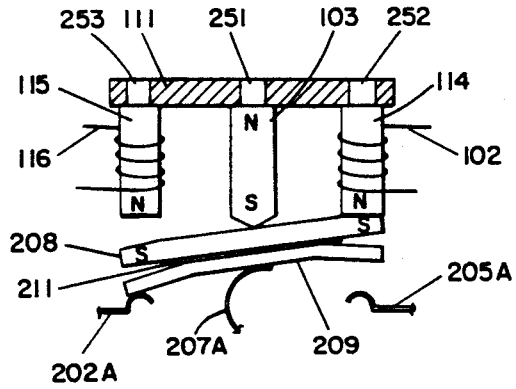
FIG. 2A is a schematic, cross-sectional representation of the basic elements of the latching relay shown in one state.
Figure 2B:
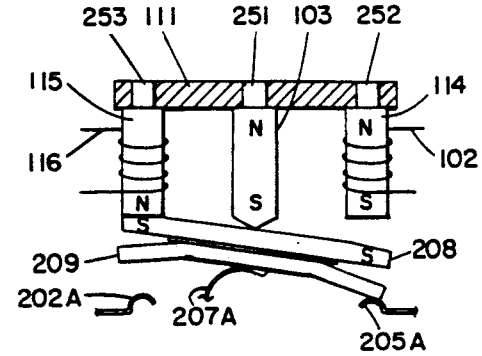
FIG. 2B is a schematic, cross-sectional representation of the basic elements of the latching relay shown in the other state.

Referring now to FIGS. 2A and 2B there is shown a schematic representation of the internal components of the coil assembly 100 and the rotor assembly 200 in the relay switch 10. In this embodiment, components similar to other components bear similar reference numerals. Morever, in the embodiment shown in FIGS. 2A and 2B, the outer housings and the membrane have been removed for convenience.

The latching relay configuration of this invention includes electromagnets having the cores 114 and 115 and the respective coils 102 and 116. As shown in FIG. 2A, the armature 208 is magnetically attracted to core 114 and held in position as a result of the magnetic attraction between the core 114 and the armature 208. With no coil excitation, the armature 208 is held in position by the flux generated by permanent magnets 103 and 128 (of which only magnet 103 is shown). The attractive force caused by the opposite magnetic polarity operating across the minimal gap at the lower pole of core 114 is orders of magnitude higher than the attractive force operating across the maximum gap at the lower pole of core 115. Thus, the relay, effectively, is latched in the position shown. The armature 208 is centrally pivoted so that when the right gap is essentially zero, the left gap is large.

The relay is switched, as shown in FIG. 2B, by applying an electrical pulse of the proper polarity to coil 102 (but not to coil 116). This pulse products a magnetic flux in core 114 which is of opposite polarity to the flux produced by the permanent magnets 103 and 128. Thus, the electromagnet flux induces a repulsion force at the lower pole of core 114. In the absence of an electrical pulse on coil 116, an attraction force is simultaneously reinforced by the electromagnet at the lower pole of core 115. If the duration of the pulse on coil 102 is long enough for the armature 208 to move through the mid-position, the armature rotates clockwise and moves into engagement with core 115. The armature 208 remains latched in that switched position (with no further input required) until coil 116 is pulsed at which time the operation is reversed.

That is, application of an electrical signal of the proper polarity to coil 116 will create a flux which tends to repel armature 208 from core 115 and the magnetic flux produced in core 114 by magnet 103 (as described above) operates to attract armature 208 to core 114.

It is seen that when the flux produced by the electrical signals in the respective windings 102 and 116 tend to alter the flux produced in the cores 114 and 115 by the permanent magnets 103 and 128, a switching operation occurs. When the signal is removed from the coil, the flux produced by the permanent magnets is sufficient to maintain the armature in the position thus established.

Of course, if the electrical signal in a winding produces a flux which does not alter the flux produced in the core by the permanent magnet, the armature does not move and the switch remains latched. This situation is contemplated wherein the electrical signal applied to coil 102 (in FIG. 2A) is of such polarity as to create an enhanced attraction force (rather than a repulsion force) at core 114. Other variations of the signal/flux/-polarity combinations need not be described in detail.

Referring now to FIG. 4, there is shown a switch assembly which provides a double-pole, double-throw contact set, capable of making, breaking, and continuously carrying a current. The DPDT contact arrangement is permitted by the pair of parallel contacts 209A and 209B. In a preferred embodiment, a current carrying capability of 1 ampere, with a potential capability of up to 2 amperes, is provided.

The fixed elements of the switch assembly are supported on the terminals of the header 201. The moving armature assembly 208 is supported from the lower support bridge 212, which is joined to header 201.

The lower support bridge 212 performs a number of important functions in this design. It permits the coil assembly 100 to be permanently mounted over the open switch assembly, thereby to ease assembly and adjustment. It also constitutes an element of the magnetic path, conducting flux from the ends of the permanent magnets and the electromagnets to the fulcrum 212A of the armature. Also, the center of the bridge functions as the armature fulcrum, tightly integrating the mechanical and magnetic designs.

The armature 208 comprises a soft magnetic iron bar, for example Carpenter Consumet Vacumet Electrical Iron, which has low remanent magnetic polarization to reduce magnetic hysteresis. The armature 208 supports the independent switching contact 209 (or contacts 209A and 209B in a DPDT configuration) made of gold-plated silver (e.g. drawn and rolled Consil 995 wire or pure rolled silver). The switching contacts 209A and 209B are mounted to, and isolated from, the armature 208 by insulating layer 211 which will not outgas at the maximum operating temperature. The contacts 209A and 209B have, in this embodiment, the ends thereof angulated to provide a wiping contact with the contacts 202A, 205A, 292A and 295A.

In one embodiment, the armature 208 is supported from the lower bridge 212 by a modified taut-band suspension 501 shown in FIG. 5. In this suspension, a thin band 501 of soft magnetic iron is tightly wrapped around the middle section 212A of the lower bridge 212 and welded to the armture 208. The middle section 212A of the lower bridge 212 includes a slightly V-shaped configuration to act as a fulcrum for the armature 208. This suspension arrangement provides virtually friction-free operation and eliminates the possibility of the armature 208 finding a neutral null position under any circumstance.

The magnetic circuit which originates from the permanent magnets 103 128, as well as the electromagnets 115 and 114, and is located within the coil assembly 100, is connected to the armature 208 through the fulcrum 212A on the lower bridge 212. The surfaces of the several magnetic elements are shaped to provide maximum flux area, minimum airgap, and low flux leakage.

In the assembly sequence, the fixed contacts 202A, 292A, 205A and 295A are first welded to the respective header pins 202, 292, 205 and 295. The armature 208 assembly is mounted to the lower support bridge 212 by means of the taut band 501 as previously described. The lower bridge 212 is then welded to the header 201. The common straps 206A and 207A are then welded to the respective header pins 206 and 207. The finished coil assembly is mounted and welded to the lower support bridge 212 and the coil terminal feedthroughs 203B and 204B are then welded to the header terminals 203 and 204, respectively.

Referring now to FIG. 6, there is shown an alternative low friction armature suspension system. This suspension system used two sharply pointed pins 606 which protrude from the lower bridge 612. The pins 606 are laser welded into the bridge 612 from the back. The armature 208 includes cone shaped cavities 607. The final piercing and control of the clearance between the lower bridge 612 and the armature 208 is provided by placing a thin metal assembly shim between the components and forcing the armature 208 onto the bridge pins 606 until bottomed out on the shim. The shim is then removed, resulting in a controlled small clearance between the armature 208 and the lower bridge 212, and a custom fit between the pins 606 and conical shaped cavities.

In operation, the magnetic attraction of the armature to the bridge holds the armature in place except under extreme shock and acceleration levels. Limit steps 608 are provided to prevent complete disengagement of the pivot pins 606 from the conical cavities during shock and acceleration. If a pivot pin is dislodged from the conical cavity, it is re-seated by the magnetic field of the unit.

Thus, there is shown and described a unique design and concept of a switching relay assembly. The particular configuration shown and described herein relates to a latching configuration. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A switch apparatus comprising,
coil assembly means,
said coil assembly means includes first and second magnetizable cores each having at least one coil winding mounted thereon and first and second permanent magnet means,
switch assembly means,
said switch assembly means includes pivotally mounted armature means,
housing means surrounding said coil assembly means and said switch assembly means, and
membrane means joined to said housing means and disposed between said coil assembly means and said switch assembly means.

2. The apparatus recited in claim 1 wherein,
said coil assembly means includes magnetic flux return path means.

3. The apparatus recited in claim 2 wherein,
said magnetic flux return path means includes a pair of magnetic flux path elements.

4. The apparatus recited in claim 1 wherein,
said membrane means is impervious to gases.

5. The apparatus recited in claim 1 wherein,
said pivotally mounted armature means is selectively positioned by said coil assembly means.

6. The apparatus recited in claim 5 including,
mounting means for mounting said armature means adjacent to said coil assembly means.

7. The apparatus recited in claim 6 wherein,
said mounting means includes a taut-band suspension system.

8. The apparatus recited in claim 6 wherein,
said mounting means includes a pivot-pin suspension system.

9. The apparatus recited in claim 5 wherein,
said housing means includes header means adjacent to said switch assembly means.

10. The apparatus recited in claim 9 including,
a plurality of contact means mounted in said header means.

11. The apparatus recited in claim 1 including,
support bridge means joined to said housing means.

12. The apparatus recited in claim 1 wherein,
said switch apparatus comprises a latching relay.

13. The apparatus recited in claim 10 including,
feedthrough connectors mounted in said membrane means and connecting at least one of said contact means in said header means to said coil assembly means.

14. The apparatus recited in claim 1 wherein, said permanent magnet is displaced from a center line of said coil assembly means.

15. The apparatus recited in claim 1 wherein,
each of said coil structures includes an electromagnetic core,
said magnetizable cores disposed adjacent opposite ends of said pivotally mounted armature means in order to selectively attract said armature means thereto.

16. The apparatus recited in claim 1 wherein,
said housing means is hermetically sealed to said membrane means.

17. The apparatus recited in claim 1 wherein,
said membrane means is substantially rigid and transmits electromagnetic energy therethrough.

18. The apparatus recited in claim 1 wherein,
said armature means is mounted to pivot about its center.

19. The apparatus recited in claim 1 wherein,
said permanent magnet means includes first and second permanent magnets.

20. The apparatus recited in claim 1 wherein,
said permanent magnet means includes a pair of permanent magnets, and
flux path means contacting one end of each of said magnetizable cores and one end of and each of said permanent magnets.

21. The apparatus recited in claim 20 wherein,
said pair of magnetizable cores arranged with the axes thereof parallel to each other,
said pair of permanent magnets arranged with the axes thereof parallel to each other and to the axes of said pair of magnetic cores.

22. The apparatus recited in claim 20 including,
second flux path means contacted by a second end of each of said permanent magnets.

23. The apparatus recited in claim 22 wherein,
said second flux path means is disposed parallel to said first flux path means and intermediate said pair of magnetic cores.

24. The apparatus recited in claim 22 wherein,
said second flux path means is disposed on the switch assembly means side of said membrane means.

25. The apparatus recited in claim 6 wherein,
said mounting means is disposed on the switch assembly side of said membrane means.

26. The apparatus recited in claim 1 wherein,
each said magnetizable core passes through said membrane means and is hermetically sealed thereto.

27. The apparatus recited in claim 1 wherein,
said support bridge means provides a magnetic flux path for said permanent magnet means.

28. The apparatus recited in claim 1 wherein,
said armature means includes a support member of magnetic material, and
electrical contact means mounted on said support member.

29. The apparatus recited in claim 28 including,
insulating material interposed between said support member and said electrical contact means.

30. The apparatus recited in claim 10 wherein,
said armature means selectively makes electrical connection with at least one of said contact means as a function of the position of said armature means.

31. The apparatus recited in claim 1 wherein
an end of at least one of said magnetizable core and said armature means is bevelled to provide a close fitting interface therebetween.

32. The apparatus recited in claim 28 including,
torsion spring connectors connected to said electrical contact means to minimize the torque applied to said armature means.

33. The apparatus recited in claim 11 wherein
said support bridge means includes a V-shaped portion thereof which serves as a fulcrum for said armature means.

34. The switch recited in claim 1 wherein,
said membrane means is comprised of a non-magnetic metal.

35. The apparatus recited in claim 10 wherein,
said contact means is formed of an electrically conductive metal,
said header means is formed of a non-magnetic metal, and
said contact means passes through said header means and is sealed in place by a non-conductive glass-to-metal seal.

36. The apparatus recited in claim 20 wherein,
said flux path means comprises a relatively planar, disk-shaped bridge formed of a magnetic material.

37. The apparatus recited in claim 20 wherein,
said flux path means transfers the magnetic flux from said permanent magnets to said magnetic cores.

38. The apparatus recited in claim 37 wherein,
said armature means transfers the magnetic flux from said permanent magnets to one of said magnetic cores.

39. The apparatus recited in claim 1 wherein,
said housing means includes an upper housing and a lower housing,
said upper housing encloses said coil assembly means,
said lower housing encloses said switch assembly means,
each of said upper and lower housing is hermetically sealed to said membrane means.

40. A latching relay switch comprising,
first and second electromagnetic coils respectively mounted on first and second cores of magnetic material,
said first and second coils disposed closely adjacent to but spaced apart from each other,
first and second permanent magnets disposed adjacent to opposite sides of said first and second coils proximate to the place where said first and second coils are closest together,
a first flux path comprising a plate joined to the top ends of each of said cores and said permanent magnets,
a second flux path comprising a plate joined to the bottom ends of said permanent magnets,
a pivotally mounted armature which selectively engages the bottom end of one of said first and second cores, and
contact means adapted to make an electrical connection dependent upon the position of said armature.

41. The switch recited in claim 40 including,
a membrane disposed above said second flux path means and below said first and second coils.

42. The latching relay recited in claim 40 wherein,
said armature remains latched to one of said first and second cores until a signal is supplied to at least one of said first and second coils to thereby alter the flux in said first and second flux paths thereby to cause said armature to move to a latched position at the other of said first and second cores.

* * * * *